US009938755B2

(12) United States Patent
Taurasi et al.

(10) Patent No.: US 9,938,755 B2
(45) Date of Patent: Apr. 10, 2018

(54) VEHICLE DOOR LATCH ASSEMBLY

(71) Applicant: MAGNA CLOSURES S.P.A., Collesalvetti (IT)

(72) Inventors: Marco Taurasi, Leghorn (IT); Enrico Boeri, Camaiore (IT)

(73) Assignee: MAGNA CLOSURES S.p.A., Collesalvetti (IT)

( * ) Notice: Subject to any disclaimer, the term of this patent is extended or adjusted under 35 U.S.C. 154(b) by 477 days.

(21) Appl. No.: 14/369,355

(22) PCT Filed: Dec. 31, 2012

(86) PCT No.: PCT/IB2012/057843
§ 371 (c)(1),
(2) Date: Jun. 27, 2014

(87) PCT Pub. No.: WO2013/102838
PCT Pub. Date: Jul. 11, 2013

(65) Prior Publication Data

US 2014/0360235 A1 Dec. 11, 2014

Related U.S. Application Data

(60) Provisional application No. 61/582,578, filed on Jan. 3, 2012.

(51) Int. Cl.
*E05B 47/06* (2006.01)
*E05B 81/06* (2014.01)
*E05B 81/90* (2014.01)

(52) U.S. Cl.
CPC ..... *E05B 81/06* (2013.01); *E05B 81/90* (2013.01); *Y10T 70/5531* (2015.04)

(58) Field of Classification Search
CPC ..... E05B 81/06; E05B 81/90; Y10T 70/5531; Y10T 70/7107
USPC ..... 70/237, 279.1; 292/201, 216, DIG. 23
See application file for complete search history.

(56) References Cited

U.S. PATENT DOCUMENTS 4,624,491 A * 11/1986 Vincent ..... E05B 81/06 185/40 R
4,667,990 A * 5/1987 Quantz ..... E05B 81/14 292/201
6,053,543 A * 4/2000 Arabia, Jr. ..... E05B 81/06 292/201

(Continued)

FOREIGN PATENT DOCUMENTS

EP 775793 A1 5/1997
WO 2009143997 A1 12/2009
WO 2011094834 A1 8/2011

*Primary Examiner* — Lloyd A Gall
(74) *Attorney, Agent, or Firm* — Dickinson Wright PLLC

(57) ABSTRACT

A vehicle door latch assembly including a vehicle door latch having a ratchet and pawl combination. The vehicle door latch assembly also includes a key receiver in which a key is rotatable. In addition, the vehicle door latch assembly includes a key receiver mechanical advantage means that is mechanically connected to the key receiver. The key receiver is operatively connected mechanically via the key receiver mechanical advantage means to the ratchet and pawl combination for release of the ratchet and pawl combination under movement of at least a part of the key receiver when mechanically engaged by the key.

14 Claims, 12 Drawing Sheets

(56) References Cited

U.S. PATENT DOCUMENTS

| | | | | |
|---|---|---|---|---|
| 6,168,215 | B1 * | 1/2001 | Kodama | E05B 81/06 292/201 |
| 7,213,428 | B2 * | 5/2007 | Harada | E05B 17/042 292/125 |
| 8,151,610 | B2 * | 4/2012 | Fujihara | E05B 77/283 292/201 |
| 8,726,705 | B2 * | 5/2014 | Tabe | E05B 79/04 70/237 |
| 2009/0160198 | A1 * | 6/2009 | Yoda | E05B 81/06 292/201 |
| 2009/0243309 | A1 * | 10/2009 | Takahashi | E05B 77/28 292/201 |
| 2011/0179835 | A1 * | 7/2011 | Tabe | E05B 79/04 70/106 |
| 2011/0204673 | A1 | 8/2011 | Francesco et al. | |
| 2012/0266639 | A1 * | 10/2012 | Yamagata | E05B 79/08 70/372 |

* cited by examiner

VEHICLE DOOR LATCH ASSEMBLY

CROSS-REFERENCE TO RELATED APPLICATIONS

This application claims the benefit of U.S. Provisional Patent Application No. 61/582,578, filed on Jan. 3, 2012, the disclosure of which is incorporated fully herein by reference.

FIELD OF THE INVENTION

The present invention is a vehicle door latch assembly at least partially operable by rotation of a key in a key cylinder.

BACKGROUND OF THE INVENTION

In a typical vehicle door latch, an electric motor opens and closes the latch. However, if the motor malfunctions, then the prior art vehicle door latch does not work properly. For example, if the motor is inoperable, the door may not open, so that a passenger may be unable to exit the vehicle.

SUMMARY OF THE INVENTION

For the foregoing reasons, there is a need for a vehicle door latch assembly that overcomes or mitigates one or more of the disadvantages of the prior art. The invention herein provides a mechanical back-up device, for mechanically opening and/or resetting the vehicle door latch, that is accessible and controllable from the exterior of the vehicle, i.e., from an exterior side of the vehicle door in which the vehicle door latch is mounted.

In its broad aspect, the invention provides a vehicle door latch assembly including a vehicle door latch having a ratchet and pawl combination. The ratchet and pawl combination includes a ratchet gear movable between a closed position, in which a striker is at least partially capturable by the ratchet gear, and an open position, in which the striker is releasable by the ratchet gear, and a primary pawl movable between a secured position, in which the primary pawl locates the ratchet gear in the closed position, and an unsecured position, in which the primary pawl is positioned to permit the ratchet gear to move to the open position thereof. The ratchet and pawl combination also includes a primary lever to which the primary pawl is connected, the primary pawl being movable between a first position, in which the primary lever holds the primary pawl in the secured position thereof, and a second position, in which the primary lever locates the primary pawl in the unsecured position thereof, the primary lever being biased to the second position thereof, and an auxiliary pawl movable between an engaged position, in which the auxiliary pawl holds the primary lever in the first position thereof, and a disengaged position, in which the auxiliary pawl is disengaged from the primary lever to permit the primary lever to move to the second position thereof. The auxiliary pawl is biased to the engaged position. The vehicle door latch also includes an electrical motor operatively connected to the ratchet and pawl combination for release and reset of the ratchet and pawl combination. The vehicle door latch assembly also includes key receiver in which a key is rotatable, and a key receiver mechanical advantage means mechanically connected to the key receiver, in which the key receiver is operatively connected mechanically via the key receiver mechanical advantage means to the ratchet and pawl combination for release of the ratchet and pawl combination under movement of at least a part of the key receiver when mechanically engaged by the key.

In another of its aspects, the key receiver is operatively connected mechanically via the key receiver mechanical advantage means to the ratchet and pawl combination for release and reset of the ratchet gear under movement of at least a part of the key receiver when mechanically engaged by the key.

In another of its aspects, the invention provides a vehicle door latch assembly including a vehicle door latch. The vehicle door latch includes a base with a body and a fishmouth slot in the body in which at least part of a striker is receivable and a ratchet gear having a slot, the ratchet gear being pivotably mounted on the base and positionable to at least partially align the slot thereof with the fishmouth slot. The ratchet gear is pivotable between a closed position, in which the striker is capturable by the ratchet gear, and an open position, in which the slot in the ratchet gear is at least partially aligned with the fishmouth slot to release the striker. The ratchet gear is biased to the open position. The vehicle door latch also includes a primary pawl movable between a secured position, in which the primary pawl locates the ratchet gear in the closed position, and an unsecured position, in which the primary pawl is positioned to permit the ratchet gear to move to the open position thereof, and a primary lever to which the primary pawl is connected, the primary lever being movable between a first position, in which the primary lever holds the primary pawl in the secured position thereof, and a second position, in which the primary lever locates the primary pawl in the unsecured position thereof. The primary lever is biased to the second position thereof. In addition, the vehicle door latch includes an auxiliary pawl movable between an engaged position, in which the auxiliary pawl holds the primary lever in the first position thereof, and a disengaged position, in which the auxiliary pawl is disengaged from the primary lever to permit the primary lever to move to the second position thereof. The auxiliary pawl is biased to the engaged position. The vehicle door latch also includes an electrical motor to provide motive force for release and reset of the ratchet gear, the primary pawl, the primary lever, and the auxiliary pawl. The vehicle door latch assembly also includes a release lever movable between a standby position, in which an engagement portion of the release lever is positioned adjacent to the auxiliary pawl while the auxiliary pawl is in the engaged position, and an active position, in which the release lever holds the auxiliary pawl in the disengaged position thereof, and a key lever, for mechanically transmitting rotation from a key cylinder to the release lever to move the release lever from the standby position thereof to the active position thereof.

In another of its aspects, the invention includes a connection element for mechanically transmitting rotation from the key cylinder to the key lever.

In another aspect, the key lever is movable between a rest position, in which the key lever holds the release lever in the standby position thereof, and a rotated position, in which the key lever holds the release lever in the active position thereof. The key lever is biased to the rest position thereof.

In yet another aspect, rotation of a key received in the key cylinder in a predetermined direction moves the key lever from the rest position to the rotated position.

In another of its aspects, the invention provides that the key cylinder is mounted in a door handle on an exterior side of a vehicle door.

In another of its aspects, the invention provides a vehicle door latch assembly including a vehicle door latch having a ratchet and pawl combination. The ratchet and pawl combination includes a ratchet gear movable between a closed position, in which a striker is at least partially capturable by the ratchet gear, and an open position, in which the striker is releasable by the ratchet gear, and a primary pawl movable between a secured position, in which the primary pawl locates the ratchet gear in the closed position, and an unsecured position, in which the primary pawl is positioned to permit the ratchet gear to move to the open position thereof. The ratchet and pawl combination also includes a primary lever to which the primary pawl is connected, the primary pawl being movable between a first position, in which the primary lever holds the primary pawl in the secured position thereof, and a second position, in which the primary lever locates the primary pawl in the unsecured position thereof, the primary lever being biased to the second position thereof, and an auxiliary pawl movable between an engaged position, in which the auxiliary pawl holds the primary lever in the first position thereof, and a disengaged position, in which the auxiliary pawl is disengaged from the primary lever to permit the primary lever to move to the second position thereof, the auxiliary pawl being biased to the engaged position. The vehicle door latch also includes an electrical motor operatively connected to the ratchet and pawl combination for release and reset of the ratchet and pawl combination. The vehicle door latch assembly includes a key receiver in which a key is rotatable, a key receiver mechanical advantage means mechanically connected to the key receiver, in which the key receiver is operatively connected mechanically via the key receiver mechanical advantage means to the ratchet and pawl combination for release and reset of the ratchet and pawl combination under movement at least a part of the key receiver when mechanically engaged by the key.

In another of its aspects, the invention provides a vehicle door latch assembly including a vehicle door latch. The vehicle door latch includes a base having a body and a fishmouth slot in the body in which at least part of a striker is receivable, a ratchet gear having a slot, the ratchet gear being pivotably mounted on the base and positionable to at least partially align the slot thereof with the fishmouth slot. The ratchet gear is pivotable between a closed position, in which the striker is capturable by the ratchet gear, and an open position, in which the slot in the ratchet gear is at least partially aligned with the fishmouth slot to release the striker, the ratchet gear being biased to the open position. The vehicle door latch also includes a primary pawl movable between a secured position, in which the primary pawl locates the ratchet gear in the closed position, and an unsecured position, in which the primary pawl is positioned to permit the ratchet gear to move to the open position thereof, and a primary lever to which the primary pawl is connected, the primary lever being movable between a first position, in which the primary lever holds the primary pawl in the secured position thereof, and a second position, in which the primary lever locates the primary pawl in the unsecured position thereof. The primary lever is biased to the second position. In addition, the vehicle door latch includes an auxiliary pawl movable between an engaged position, in which the auxiliary pawl holds the primary lever in the first position thereof, and a disengaged position, in which the auxiliary pawl is disengaged from the primary lever to permit the primary lever to move to the second position thereof, the auxiliary pawl being biased to the engaged position, and an electrical motor operatively connected to the ratchet gear, the primary lever and the auxiliary pawl for release and reset thereof. The vehicle door latch assembly also includes an auxiliary lever movable to a reset position, in which the auxiliary lever urges the primary lever to the first position thereof, and to an inactive position, in which the auxiliary lever permits the primary lever to move to the second position thereof, and a key lever, for mechanically transmitting rotation from a key cylinder for moving the key lever to a first active position, in which the key lever urges the auxiliary pawl to the disengaged position thereof, and to a second active position, in which they key lever urges the auxiliary lever to the reset position thereof.

In another of its aspects, rotation of a key in the key cylinder in a first preselected direction moves the key lever to the first active position, and rotation of the key in a second preselected direction moves the key lever to the second active position.

In yet another aspect, the key lever extends between an input end thereof mechanically connected to the key cylinder for transmission of rotation of the key when received in the key cylinder to the input end and an output end thereof configured for engagement with the auxiliary pawl when the key lever is in the first active position and for engagement with the auxiliary lever when the key lever is in the second active position. Also, the key lever is positionable in an intermediate position between the first and second active positions in which the key lever is inactive.

In another aspect, the auxiliary lever extends between first and second ends thereof; and upon the output end of the key lever engaging the first end of the auxiliary lever to urge the first end to move in a first predetermined direction, the second end of the auxiliary lever also moves in the first predetermined direction to engage the primary lever and to urge the primary lever to the first position thereof.

In another of its aspects, the invention provides a vehicle door latch assembly including a ratchet gear movable between a closed position in which a striker is capturable thereby and an open position in which the striker is releasable thereby, the ratchet gear being biased to the open position, and a primary pawl movable between a secured position, in which the primary pawl locates the ratchet gear in the closed position, and an unsecured position, in which the primary pawl is positioned to permit the ratchet gear to move to the open position thereof. The vehicle door latch assembly also includes a primary lever to which the primary pawl is connected, the primary lever being movable between a first position, in which the primary lever holds the primary pawl in the secured position thereof, and a second position, in which the primary lever locates the primary pawl in the unsecured position thereof, the primary lever being biased to the second position, and an auxiliary pawl movable between an engaged position, in which the auxiliary pawl holds the primary lever in the first position thereof, and a disengaged position, in which the auxiliary pawl is disengaged from the primary lever to permit the primary lever to move to the second position thereof, the auxiliary pawl being biased to the engaged position. In addition, the vehicle door latch assembly includes an electrical motor operatively connected to the ratchet gear, the primary pawl, the primary lever, and the auxiliary pawl for release and reset thereof, and an auxiliary lever movable to a reset position, in which the auxiliary lever urges the primary lever to the first position thereof, and to an inactive position, in which the auxiliary lever permits the primary lever to move to the second position thereof. The vehicle door latch also includes a key lever, for mechanically transmitting rotation from a key cylinder for moving the key lever to a first active position, in which the key lever urges the auxiliary pawl to the disengaged position thereof, and to a second active position, in which the key lever urges the auxiliary lever to the reset position thereof.

In another aspect, rotation of a key received in the key cylinder in a first preselected direction moves the key lever to the first active position, and rotation of the key in a second preselected direction moves the key lever to the second active position.

In another of its aspects, the key lever extends between an input end connected to the key cylinder and an output end engaged with the auxiliary pawl when the key lever is in the first active position and engaged with the auxiliary lever when the key lever is in the second active position, and the key lever is positionable in an intermediate position between the first and second active positions in which the key lever is inactive.

In yet another of its aspects, the auxiliary lever extends between first and second ends thereof, and upon the output end of the key lever engaging the first end of the auxiliary lever to urge the first end to move in a first predetermined direction, the second end of the auxiliary lever moves in the first predetermined direction to urge the primary lever to the first position thereof.

BRIEF DESCRIPTION OF THE DRAWINGS

The invention will be better understood with reference to the attached drawings, in which.

DETAILED DESCRIPTION

Figure 2A:
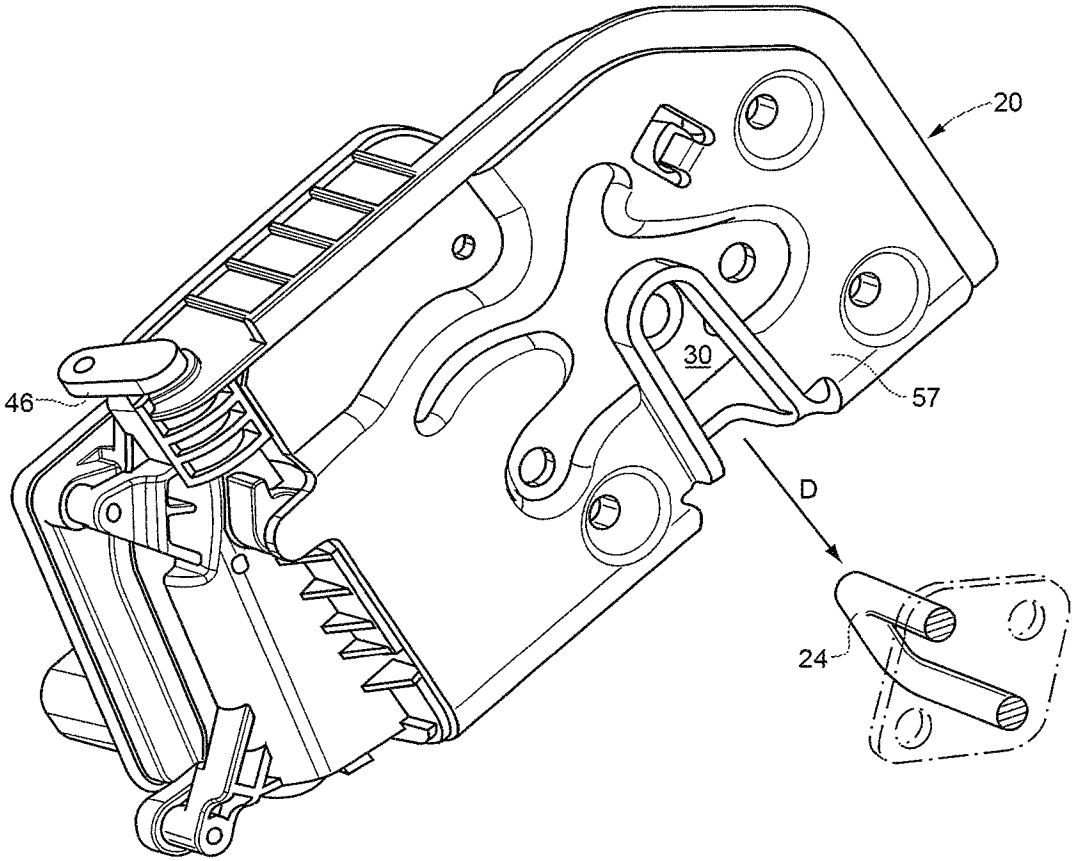
FIG. 2A is an isometric view of an embodiment of a vehicle door latch of the vehicle door latch assembly of FIG. 1A, drawn at a smaller scale.
Figure 3:
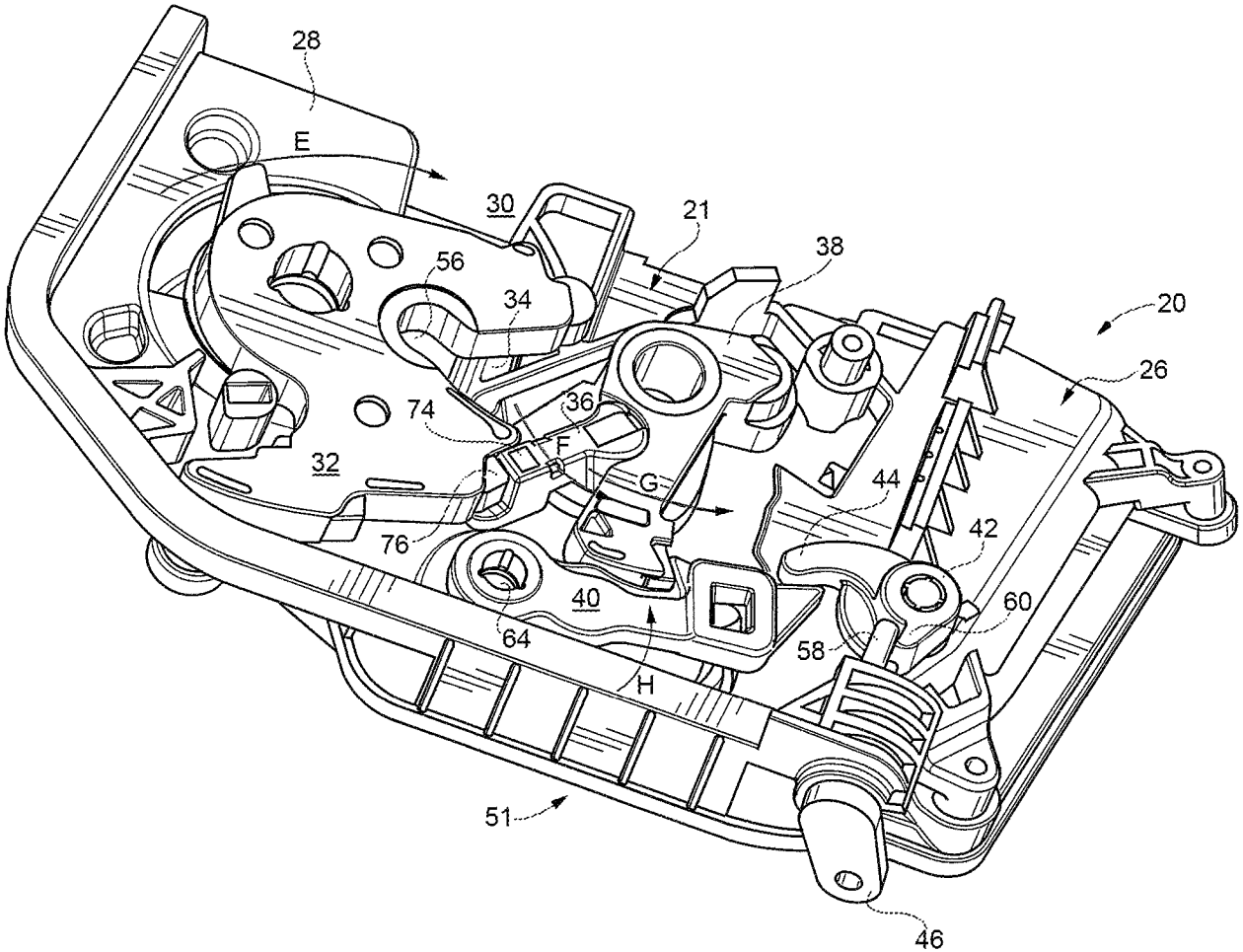
FIG. 3 is an isometric view of the vehicle door latch of FIG. 2A with a cover plate thereof removed in which the vehicle door latch is in a closed condition, drawn at a larger scale.
Figure 4:
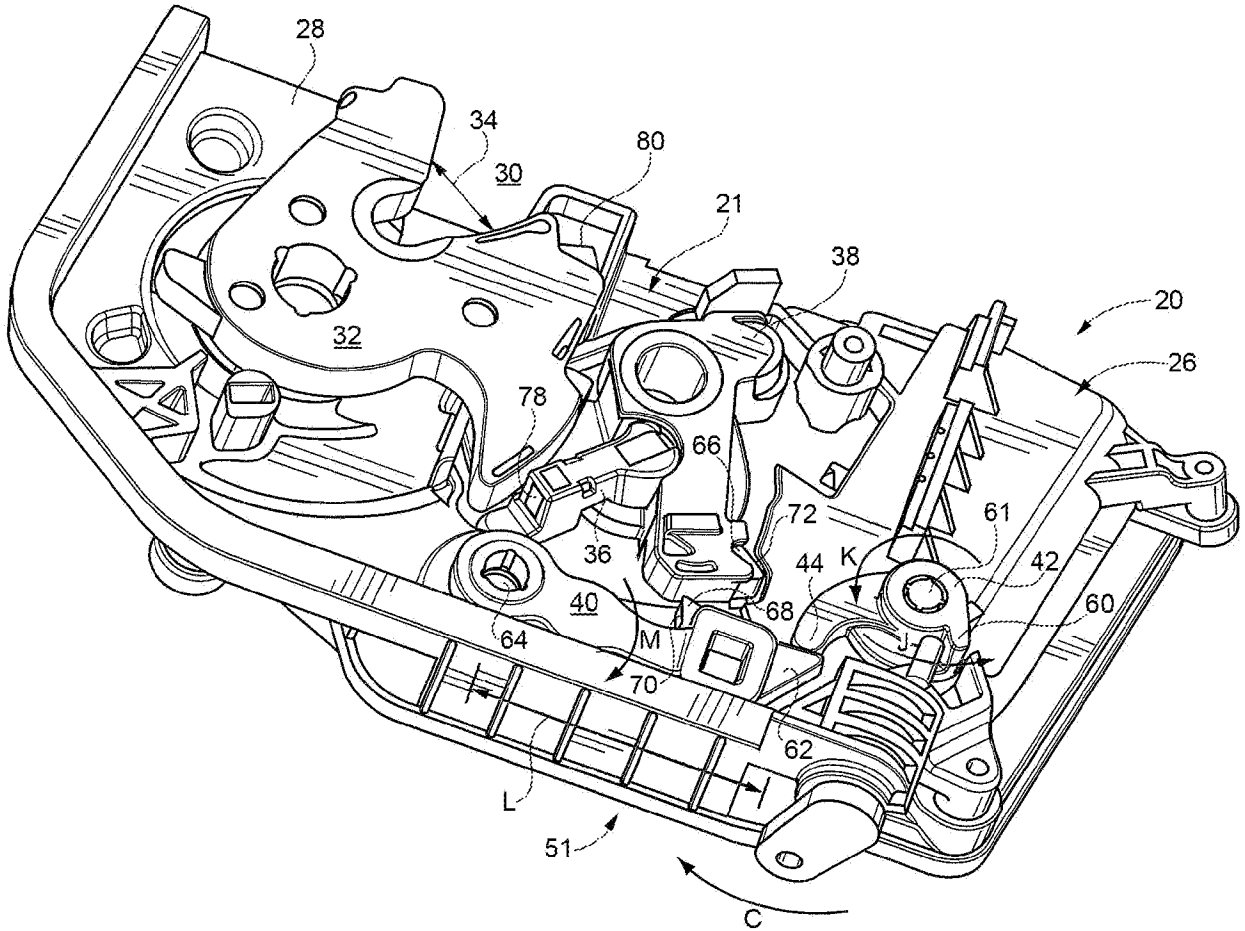
FIG. 4 is an isometric view of the vehicle door latch of FIG. 3 in which the vehicle door latch is in an open condition.

In the attached drawings, like reference numerals designate corresponding elements throughout. Reference is first made to FIGS. 1A-4 to describe an embodiment of a vehicle door latch assembly referred to generally by the numeral 18. As will be described, the vehicle door latch assembly 18 preferably includes a vehicle door latch 20 with a ratchet and pawl combination 21 (FIGS. 3 and 4). As can be seen in FIGS. 3 and 4, in one embodiment, the vehicle door latch 20 preferably includes a base 26 including a body 28 and a fishmouth slot 30 in the body 28 in which at least part of a striker 24 is receivable. Preferably, the vehicle door latch 20 also includes a ratchet gear 32 with a slot 34, the ratchet gear 32 being pivotably mounted on the base 26 and positionable to at least partially align the slot 34 thereof with the fishmouth slot 30. It is also preferred that the ratchet gear 32 is pivotable between a closed position (FIG. 3), in which the striker 24 is capturable by the ratchet gear 32, and an open position (FIG. 4), in which the slot 34 in the ratchet gear 32 is at least partially aligned with the fishmouth slot 30 to release the striker 24. Preferably, the ratchet gear 32 is biased to the open position, and the vehicle door latch 20 additionally includes a primary pawl 36 movable between a secured position (FIG. 3), in which the primary pawl 36 locates the ratchet gear 32 in the closed position, and an unsecured position (FIG. 4), in which the primary pawl 36 is positioned to permit the ratchet gear 32 to move to the open position thereof. As can be seen in FIGS. 3 and 4, in one embodiment, the vehicle door latch 20 preferably also includes a primary lever 38 to which the primary pawl 36 is connected, the primary lever 38 being movable between a first position (FIG. 3), in which the primary lever 38 holds the primary pawl 36 in the secured position thereof, and a second position (FIG. 4), in which the primary lever 38 locates the primary pawl 36 in the unsecured position thereof, the primary lever 38 being biased to the second position thereof. It can also be seen in FIGS. 3 and 4 that the vehicle door latch 20 preferably also includes an auxiliary pawl 40 movable between an engaged position (FIG. 3), in which the auxiliary pawl 40 holds the primary lever 38 in the first position thereof, and a disengaged position (FIG. 4), in which the auxiliary pawl 40 is disengaged from the primary lever 38 to permit the primary lever 38 to move to the second position thereof, the auxiliary pawl 40 being biased to the engaged position thereof. As will also be described, the vehicle door latch 20 preferably also includes an electrical motor (41) to provide motive force for release and reset of the ratchet gear (32), the primary pawl (36), the primary lever (38), and the auxiliary pawl (40). Preferably, a release lever 42 is also included in the vehicle door latch assembly 18. As can be seen in FIGS. 3 and 4, the release lever 42 is movable between a standby position (FIG. 3), in which an engagement portion 44 of the release lever 42 is positioned adjacent to the auxiliary pawl 40 while the auxiliary pawl 40 is in the engaged position, and an active position (FIG. 4), in which the release lever 42 holds the auxiliary pawl 40 in the disengaged position thereof. It is also preferred that the vehicle door latch assembly 18 includes a key lever 46, for transmitting rotation from a key cylinder 50 to the release lever 42 to move the release lever 42 from the standby position to the active position thereof.

As will also be described, it is preferred that the vehicle door latch assembly 18 also includes a connecting element 54 for mechanically transmitting rotation from the key cylinder 50 to the key lever 46.

As can also be seen in FIGS. 3 and 4, in one embodiment, the key lever 46 preferably is movable between a rest position (FIG. 3), in which the key lever 46 holds the release lever 42 in the standby position thereof, and a rotated position (FIG. 4), in which the key lever 46 holds the release lever 42 in the active position thereof, the key lever 46 being biased to the rest position thereof. Preferably, rotation of a key 22 in the key cylinder 50 in a predetermined direction indicated by arrow "A" in FIG. 1C moves the key lever 46 from the rest position to the rotated position thereof, as will also be described. It will be understood that, to move the key lever 46 from the rest position to the rotated position thereof, the key 22 preferably is rotated a predetermined distance in the predetermined direction.

Figure 1A:
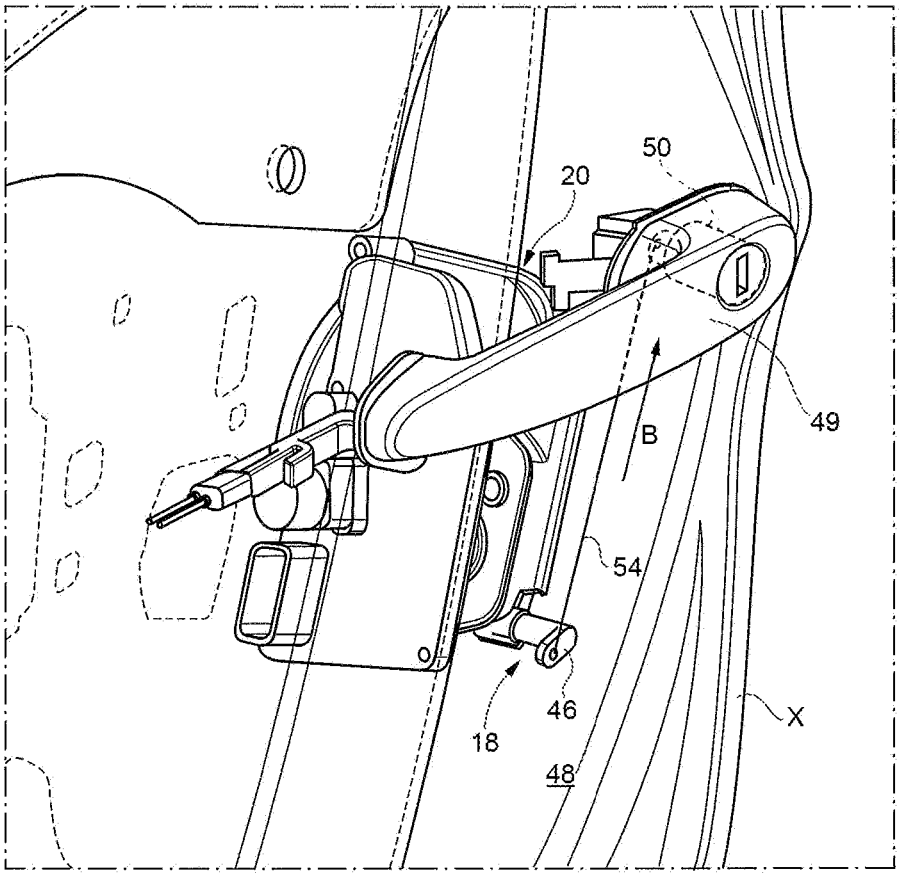
FIG. 1A is an isometric view of a vehicle door in which an embodiment of a vehicle door latch assembly of the invention is mounted.
Figure 1B:
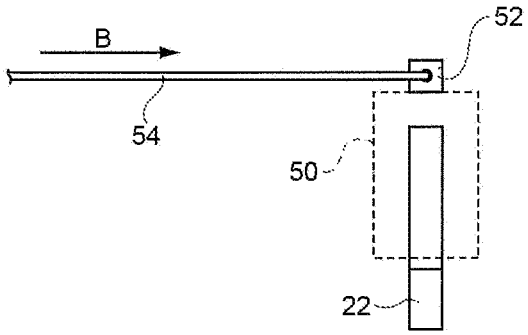
FIG. 1B is a top view of a key cylinder and a key, drawn at a larger scale.
Figure 1C:
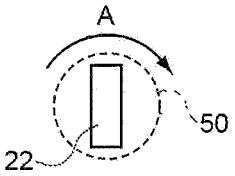
FIG. 1C is a front view of the key cylinder and the key of FIG. 1B.

As can be seen in FIGS. 1A-1C, in one embodiment, the vehicle door latch assembly 18 preferably is mounted in a vehicle door 48. An exterior side "X" of the vehicle door is shown in FIG. 1A. The key cylinder 50 in which the key 22 is receivable, illustrated in FIGS. 1B and 1C, preferably is mounted in the vehicle door handle 49 on the exterior side "X", and is accessible from the exterior of the door. Those skilled in the art would appreciate that the key cylinder 50 may be mounted in the door in any suitable fashion. It will be understood that the key 22 is omitted from FIG. 1A for clarity of illustration. The key cylinder 50 preferably includes a linkage element 52 operably connected to a connecting element 54 that connects the linkage element 52 to the key lever 46.

When the key 22 is positioned in the key cylinder 50 and rotated in the predetermined direction, the linkage element 52 is rotated in the same direction, by the same radial distance, and pulls the connecting element 54 in the direction indicated by arrow "B" in FIGS. 1A and 1B. In order to move the key lever 46 from the rest position to the rotated position, the key 22 is rotated a predetermined radial distance in the predetermined direction. Because the connecting element 54 is connected to the key lever 46, the key lever 46 is rotated in the direction indicated by arrow "C" in FIG. 4 when the connecting element 54 is moved in the direction indicated by arrow "B". In this way, rotation is mechanically transmitted from the key cylinder 50 to the release lever 42.

It will be understood that the connecting element 54 is omitted from FIGS. 2A-4 for clarity of illustration.

As noted above, rotation of the key 22 in the predetermined direction moves the key lever 46. In order to move the key lever 46 from the rest position (FIG. 3) to the rotated position (FIG. 4), the key 22 is rotated the predetermined radial distance (e.g., 90°).

Those skilled in the art would be aware that the predetermined radial distance may be any suitable distance. Because the key cylinder 50 and the connecting element 54 are known in the art, further description of them is unnecessary.

From the foregoing, it will be appreciated by those skilled in the art that the vehicle door latch 20 is shown in a closed condition in FIG. 3, and it is shown in an open condition in FIG. 4. In FIG. 4, the slot 34 is at least partially aligned with the fishmouth slot 30, so that the striker 24 is at least partially receivable in the slot 34. As can be seen in FIG. 2A, when the ratchet gear 32 is in the open position and the door 48 swings in the direction indicated by arrow "D", the striker 24 is at least partially received in the slot 34.

Those skilled in the art would also appreciate that, when the striker 24 is partially positioned in an end portion 56 (FIG. 3) of the slot 34, rotation of the ratchet gear 34 from the open position to the closed position results in the striker 24 being captured by the ratchet gear 34. It will be understood that the vehicle door latch 20 is movable from the open condition to the closed condition (i.e., reset) and moveable from the closed condition to the open condition (i.e., released) by the motor 141 (FIG. 2C), which preferably is energizable by energy provided in the vehicle, and mechanisms associated therewith, as shown and described in the Applicant's co-pending application number PCT/EP2012/002238 and entitled "Double Ratchet, Double Pawl Vehicular Latch with Soft Stop on Reset", the disclosure of which is incorporated fully herein by reference.

Figure 2B:
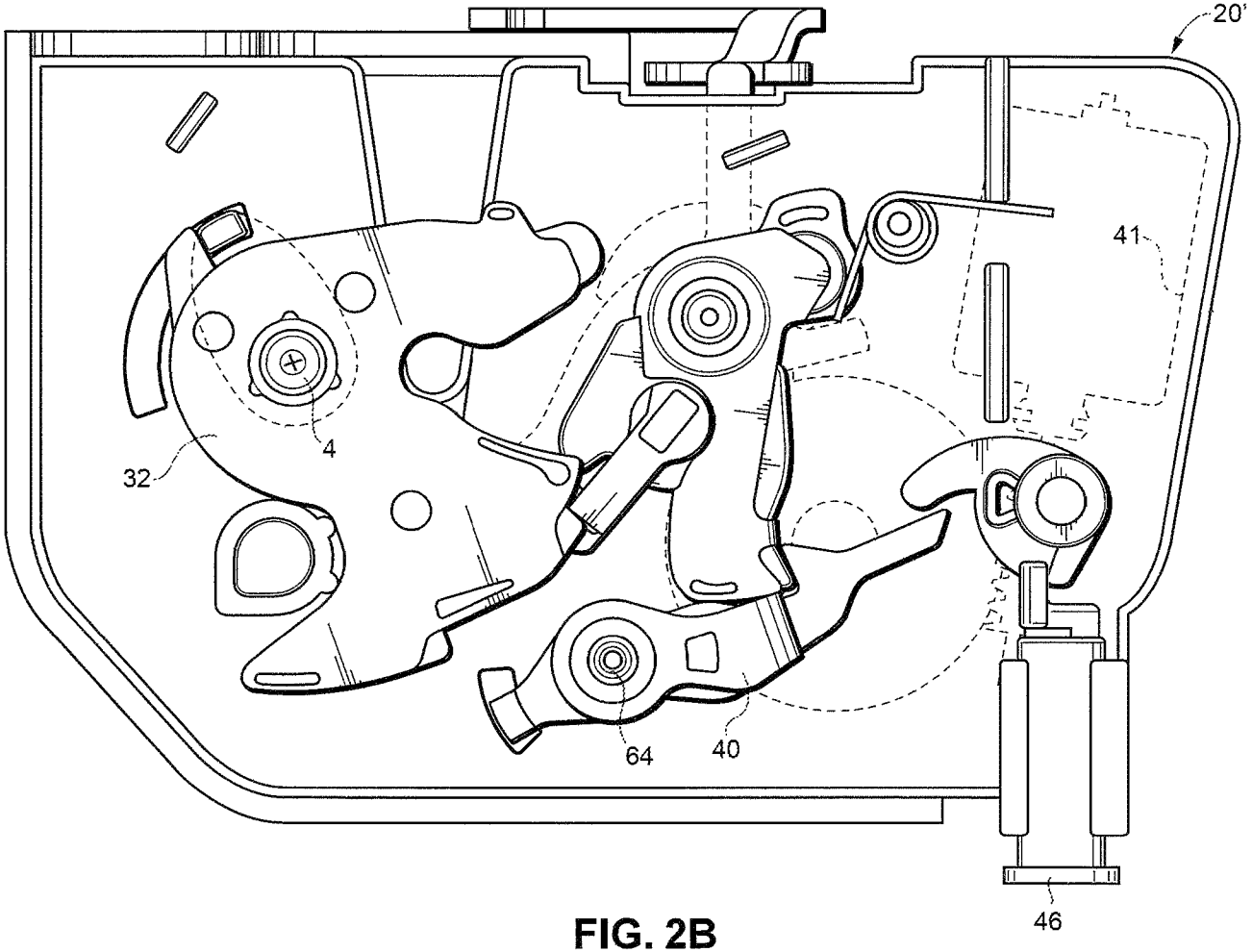
FIG. 2B is a plan view of a front side of an alternative embodiment of a vehicle door latch assembly of the invention with a front cover plate removed from view, drawn at a larger scale.
Figure 2C:
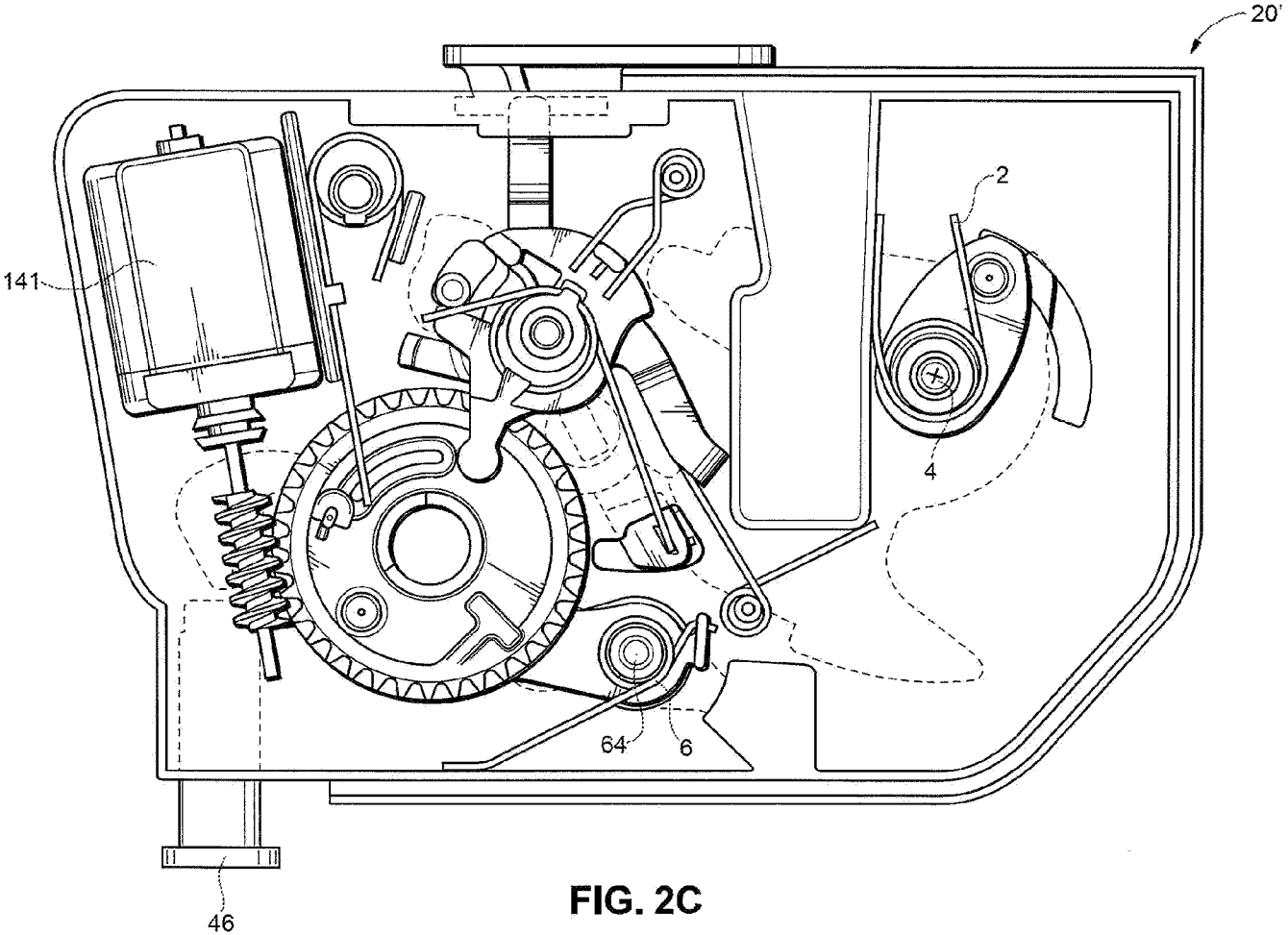
FIG. 2C is a plan view of a rear side of the vehicle door latch assembly of FIG. 2B with a rear cover plate removed from view.

An example of the vehicle door latch is illustrated in FIGS. 2B and 2C, being generally referred to by the reference numeral 20' for convenience. It will be understood that the vehicle door latch 20' (FIGS. 2B, 2C) is substantially the same as the vehicle door latch 20 (FIGS. 2A, 3, and 4), with only minor differences therebetween that are not material for the purposes hereof. It will be understood that the vehicle door latch 20' includes cover plates that are omitted from FIGS. 2B and 2C for clarity of illustration.

It will also be understood that the vehicle door latch 20' includes a key lever 46 for connection to the key cylinder. The connecting element 54 and the key cylinder 50 are omitted from FIGS. 2B and 2C for clarity of illustration. The vehicle door latch 20' is illustrated in FIGS. 2B and 2C to show the electrical motor 141 and the biasing means used to bias selected elements of the ratchet and pawl combination. As can be seen in FIG. 2C, for instance, biasing means 2 is a spring for biasing the ratchet gear 32 (FIG. 2B) to pivot about a post 4 to the open position of the ratchet gear 32. Also, and as can be seen in FIG. 2C, biasing means 6 is a spring positioned at least partially around a post 64 about which the auxiliary pawl 40 is pivotable. The spring 6 biases the auxiliary pawl 40 to the engaged position thereof. The electrical motor 41 and the mechanisms associated therewith that operatively connect the electrical motor 41 and the ratchet and pawl combination 21 can also be seen in FIG. 2C. Because the operative connection of the electrical motor 41 and the ratchet and pawl combination 21 has been described in application number PCT/EP2012/002238 referred to above, further description thereof is also unnecessary. It will be understood that the biasing means and the electrical motor of the vehicle door latch 20 and the mechanisms associated therewith that operatively connect the electrical motor 41 and the ratchet and pawl combination 21 are not shown in FIGS. 3 and 4 for clarity of illustration. Because the use of biasing means is well known in the art, further description thereof is unneccesary.

The vehicle door latch 20 preferably includes a cover plate 57. It will be understood that the cover plate 57 is omitted from FIGS. 3 and 4 for clarity of illustration.

As can be seen most clearly in FIGS. 3 and 4, the vehicle door latch 20 preferably includes the ratchet and pawl combination 21, which includes the ratchet gear 32, the primary pawl 36, the primary lever 38, and the auxiliary pawl 40. As noted above, the electrical motor 41 (not shown in FIGS. 3 and 4) preferably is operatively connected to the ratchet and pawl combination 21 for release and reset of the ratchet and pawl combination 21. The vehicle door latch assembly 18 includes the vehicle door latch 20, and preferably also includes the key receiver (or key cylinder) 50 in which the key 22 is rotatable. It is also preferred that the vehicle door latch assembly 18 includes a key receiver mechanical advantage means 51 mechanically connected to the key receiver 50. Preferably, the key receiver 50 is operatively connected mechanically via the key receiver mechanical advantage means 51 to the ratchet and pawl combination 21 for release of the ratchet and pawl combination 21 under movement of at least a part 52 of the key receiver 50 when mechanically engaged by the key 22. In this way, the vehicle door latch assembly 18 provides a mechanical release means for moving the vehicle door latch 20 from the closed condition to the open condition. From the foregoing, it can be seen that the vehicle door latch assembly 18 is operable from the exterior of the vehicle. Accordingly, the vehicle door latch assembly 18 may be used if the motor 41 is inoperable, for example, due to a failure of the power supply to the motor 41.

The vehicle door latch assembly 18 will now be described in more detail. As described above, the ratchet gear 32 preferably is biased to the open position. In FIG. 3, the direction of movement of the ratchet gear 32 from the closed position to the open position thereof is indicated by arrow "E". It is also preferred that the primary pawl 36 is biased to the unsecured position thereof, i.e., the primary pawl 36 is biased for movement in the direction indicated by arrow "F" in FIG. 3. The primary lever 38 preferably is biased to the second position thereof. In FIG. 3, the direction of movement of the primary lever 38 from the first position to the second position thereof is indicated by arrow "G".

As can be seen in FIG. 3, when the vehicle door latch 20 is in the closed condition, the auxiliary pawl 40 is in the engaged position, holding the primary lever 38 in the first position thereof. It is preferred that the auxiliary pawl 40 is biased to the engaged position. In FIG. 3, the direction of movement of the auxiliary pawl 40 from the disengaged position to the engaged position thereof is indicated by arrow "H". Also, in one embodiment, the key lever 46 preferably is biased to the rest position thereof.

As described above, when the key 22 is rotated in the predetermined direction by the predetermined radial distance, because of the mechanical connection therebetween, the key lever 46 is caused thereby to move from the rest position to the rotated position thereof. This causes the vehicle door latch 20 to move from the closed condition, illustrated in FIG. 3, to the open condition, illustrated in FIG. 4. It will be understood that, although a sequence of movements of various elements respectively of the vehicle door latch assembly 18 is described hereinafter, such movements take place virtually concurrently.

As noted above, rotation of the key 22 in the predetermined direction ultimately causes the key lever 46 to rotate in the direction indicated by arrow "C" in FIG. 4. Rotation of the key 22 in the predetermined direction by the predetermined radial distance causes the key lever 46 to rotate from the rest position (shown in FIG. 3) to the rotated position (shown in FIG. 4).

The key lever 46 preferably includes a finger 58 positioned for engagement with a tab 60 of the release lever 42. As can be seen in FIG. 4, when the key lever 46 is rotated in the direction indicated by arrow "C", the finger 58 pushes against the tab 60 in the direction indicated by arrow "J", thereby causing the release lever 42 to pivot about a pivot axis 61 in the direction indicated by arrow "K".

It can also be seen in FIG. 4 that rotation of the release lever 42 in the direction indicated by arrow "K" causes the engagement portion 44 to push against an end part 62 of the auxiliary pawl 40. The engagement portion 44 of release lever 42 urges the auxiliary pawl 40 in the direction indicated by arrow "M" in FIG. 4.

As can be seen in FIG. 4, the auxiliary pawl 40 is pivotable about a pivot pin 64, and the auxiliary pawl 40 is relatively long, having a length "L" between the pivot axis 64 and the end part 62. The biasing load is, in effect, applied substantially at the pin 64, biasing the auxiliary pawl 40 to the engaged position. As described above, the release lever 42 urges the auxiliary pawl 40 to the disengaged position. The effort to overcome the biasing means is applied at the end part 62, i.e., at a point located at the distance "L" from the pivot pin 64. Those skilled in the art would appreciate that applying the load to overcome the bias at the relatively long length "L" from the pin 64 therefore provides a mechanical advantage, so that relatively little force is required to be exerted when the key 22 is rotated in the predetermined direction in order to move the vehicle door latch 20 from the closed condition to the open condition.

From the foregoing, it can be seen that the mechanical advantage means 51 preferably includes the elements that mechanically connect the key receiver or key cylinder 50 with the release lever 42, which utilizes the mechanical advantage described above. Preferably, the mechanical advantage means 51 includes the connecting element 54, the key lever 46, and the release lever 42.

As shown in FIG. 3, when the vehicle door latch 20 is in the closed condition, a toe 66 of the primary lever 38 engages a stop portion 68 of the auxiliary pawl 40. It can be seen in FIG. 3 that the toe 66 preferably is formed to fit against the stop portion 68, so that the primary lever 38 is securely held by the auxiliary pawl 40.

However, as can be seen in FIG. 4, when the bias of the auxiliary pawl 40 is overcome, and the auxiliary pawl 40 is moved to the disengaged position, the stop portion 68 is moved away from the toe 66, so that the primary lever 38 is allowed to pivot to the second position thereof, illustrated in FIG. 4. The direction of movement of the primary lever 38 from the first position to the second position thereof is indicated by arrow "G" in FIG. 3.

As can be seen in FIGS. 3 and 4, the stop portion 68 preferably is formed so that a face 70 thereof is substantially aligned with the direction of movement of the auxiliary pawl 40 about the pivot axis 64. Preferably, the toe 66 has a corresponding end surface 72 that is formed to be generally parallel to the face 70 when the face 70 and the end surface 72 are engaged. This facilitates the separation of the face 70 and the end surface 72 when the auxiliary pawl 40 pivots from the engaged position thereof to the disengaged position thereof.

As can be seen in FIG. 3, when the vehicle door latch 20 is in the closed condition, an end portion 74 of the primary pawl 36 engages a step 76 formed in the ratchet gear 32. Because of this engagement, the primary pawl 36 holds the ratchet gear 32 in the closed position thereof.

However, when the primary lever 38 is allowed to pivot to its second position (illustrated in FIG. 4), because the primary pawl 36 is connected to the primary lever 38, the primary pawl 36 is thereby pulled away from engagement with the ratchet gear 32, i.e., the primary pawl 36 is moved from its secured position to its unsecured position. This movement is in the direction indicated by arrow "F" in FIG. 3. The end portion 74 preferably includes a substantially flat surface 78 that engages a mating surface 80 on the step 76 (FIG. 4), and the surfaces are formed and positioned so that movement of the primary pawl 36 to the unsecured position is relatively unimpeded.

When the primary pawl 36 is moved from the secured position thereof to the unsecured position thereof, the ratchet gear 32 is permitted to pivot from the closed position to the open position thereof (shown in FIG. 4), i.e., in the direction indicated by arrow "E" in FIG. 3. As described above, the ratchet gear 32 pivots in the direction indicated by arrow "E" because it is biased to the open position.

INDUSTRIAL APPLICABILITY

In use, when the vehicle door latch 20 is in the closed condition (e.g., the door is closed, with the striker 24 at least partially captured by the ratchet gear 32), a user (not shown) located outside the vehicle may, by inserting the key 22 into the key cylinder 50 and rotating the key 22 the predetermined radial distance in the predetermined direction, cause the vehicle door latch 20 to be moved from the closed condition to the open condition. As noted above, due to the arrangement and configuration of the elements of the vehicle door latch 20, relatively little force is required to be exerted by the user when rotating the key in order to accomplish this. When the vehicle door latch 20 is in the open condition, the striker 24 is released by the ratchet gear 32, and the door can be opened.

As noted above, the vehicle door latch 20 is normally moved from the closed condition thereof to the open condition thereof by the electrical motor 41, controlled via control means not shown herein. The vehicle latch assembly 18 provides a mechanical means for opening the vehicle door latch 20 when the motor, or mechanisms related to the motor, are inoperable. For example, if a passenger is trapped inside the vehicle because the motor of the vehicle door latch 20 is inoperable, the vehicle door latch assembly 18 enables the user to open the vehicle door latch 20 from outside the vehicle using only mechanical means.

When the key 22 in the key cylinder 50 is rotated in the predetermined direction (i.e., in the direction indicated by arrow "A" in FIG. 1C), the connecting element 54 is moved in the direction indicated by arrow "B" in FIGS. 1A and 1B. Also, movement of the connecting element 54 in the direction indicated by arrow "B" causes the key lever 46 to rotate in the direction indicated by arrow "C" in FIG. 4. If the key 22 is rotated the predetermined radial distance in the predetermined direction, then the key lever 46 is moved from the rest position thereof (FIG. 3) to the rotated position thereof (FIG. 4), causing the finger 58 thereof to move in the direction indicated by arrow "J" in FIG. 4.

As described above, when the key lever 46 rotates in the direction indicated by arrow "C" to the rotated position thereof, the finger 58 pushes the release lever 42 to pivot in the direction indicated by arrow "K" in FIG. 4 from its standby position (FIG. 3) to its active position (FIG. 4). As this occurs, the engagement portion 44 of the release lever 42 pushes against the end part 62 of the auxiliary pawl 40, pivoting the auxiliary pawl 40 about its pivot axis 64 in the direction indicated by arrow "M" in FIG. 4 from the engaged position thereof to the disengaged position thereof. This releases the toe 66 of the primary lever 38 from engagement with the stop portion 68 of the auxiliary pawl 40, allowing the primary lever 38 to move in the direction indicated by arrow "G" in FIG. 3 from the first position thereof to the second position thereof, due to the primary lever 38 being biased to do so.

In so doing, the primary lever 38 pulls the primary pawl 36 away from engagement with the ratchet gear 32, i.e., the flat surface 78 of the end portion 74 of the primary pawl 36 slides away from the surface 80 of step 76 in the ratchet gear 32. When this occurs, the ratchet gear 32 is allowed to move in the direction indicated by arrow "E" from its closed position to its open position, due to it being biased to do so.

As described above, due to the arrangement of the two pawls 36, 40 working together in the vehicle door latch 20, relatively little effort is needed when the key 22 in the key cylinder 50 is turned to move the vehicle door latch 20 from the closed condition to the open condition. Among other advantages, because of this, a relatively lightweight connecting element 54 (e.g., made of steel or plastic, or any other suitable material) can be used.

Alternative embodiments of the vehicle door latch assembly 118 and the vehicle door latch 120 included therein are illustrated in FIGS. 5A-5G. In this embodiment of the vehicle door latch assembly 118, the vehicle door latch 120 may be moved to an open condition thereof mechanically, and the vehicle door latch 120 may also be reset mechanically to the closed condition. As will be described, the vehicle door latch assembly 118 provides an alternative, mechanical means for operating the vehicle door latch 120 that may be used when the electrical motor or the mechanical connection between it and a ratchet and pawl combination 121 is inoperable.

Figure 5A:
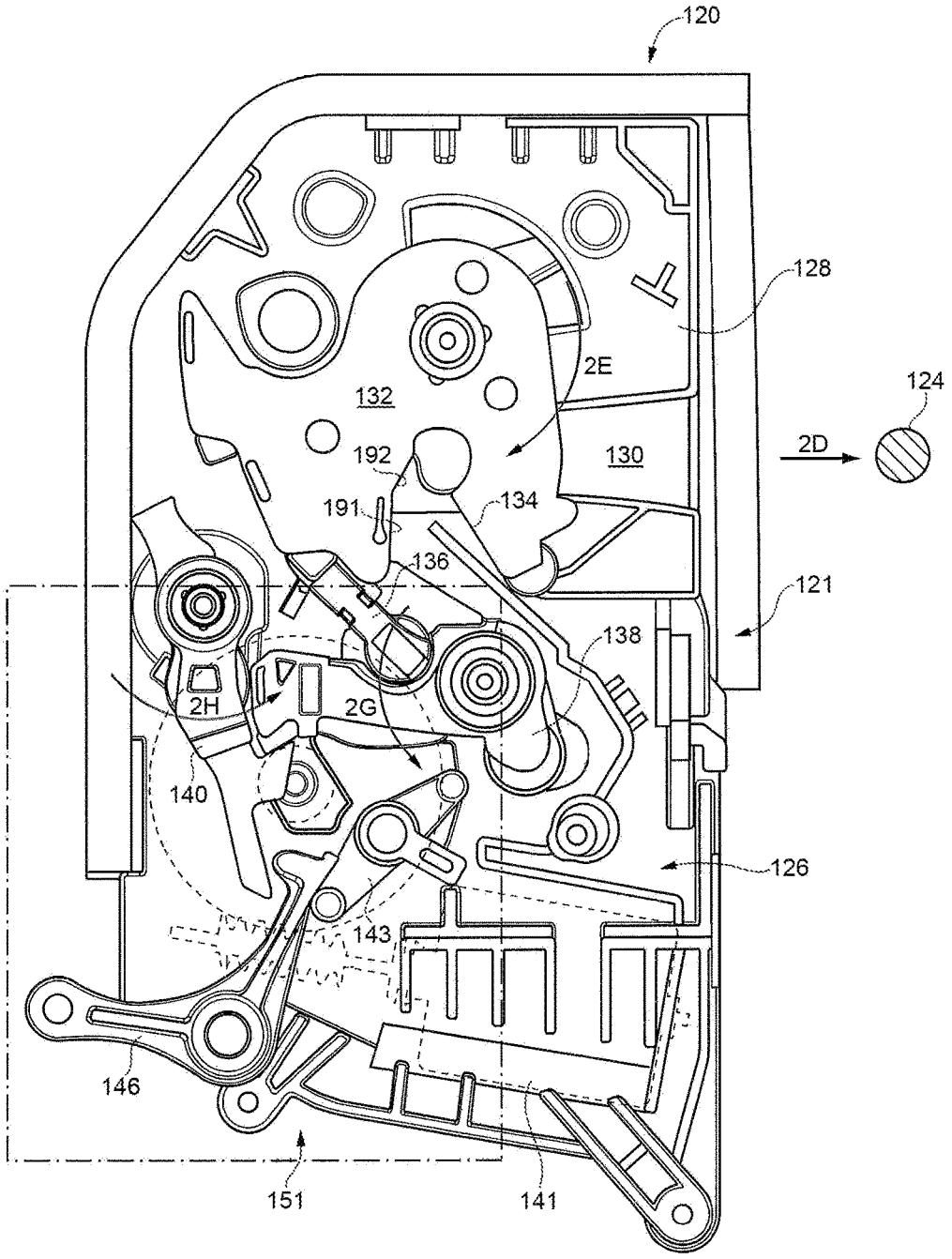
FIG. 5A is a front view of an alternative embodiment of the vehicle door latch of the invention, drawn at a smaller scale.

The vehicle door latch assembly 118 preferably is operable by rotation of a key 122 (FIGS. 5E, 5F) for capturing and releasing a striker 124 (FIG. 5A). In one embodiment, the vehicle door latch 120 preferably includes a base 126 having a body 128 and a fishmouth slot 130 in the body 128 in which at least part of the striker 124 is receivable. As can be seen in FIG. 5A, the vehicle door latch 120 preferably also includes a ratchet gear 132 with a slot 134 therein, the ratchet gear 132 being pivotably mounted on the base 126 and positionable to at least partially align the slot 134 thereof with the fishmouth slot 130. As will be described, the ratchet gear 132 preferably is pivotable between a closed position (FIG. 5A), in which the striker 124 is capturable by the ratchet gear 132, and an open position, in which the slot 134 in the ratchet gear 132 is at least partially aligned with the fishmouth slot 130 to release the striker 124, the ratchet gear 132 being biased to the open position. It is also preferred that the vehicle door latch 120 includes a primary pawl 136 movable between a secured position (FIG. 5A), in which the primary pawl 136 locates the ratchet gear 132 in the closed position, and an unsecured position (FIG. 5C), in which the primary pawl 136 is positioned to permit the ratchet gear 132 to move to the open position thereof. In one embodiment, the vehicle door latch assembly 120 preferably also includes a primary lever 138 to which the primary pawl is connected, the primary lever 138 being movable between a first position (FIGS. 5A, 5B), in which the primary lever 138 holds the primary pawl 136 in the secured position thereof, and a second position (FIG. 5C), in which the primary lever 138 locates the primary pawl 138 in the unsecured position thereof, the primary lever 138 being biased to the second position. In addition, the vehicle door latch 120 preferably includes an auxiliary pawl 140 movable between an engaged position (FIGS. 5A, 5B), in which the auxiliary pawl 140 holds the primary lever 138 in the first position thereof, and a disengaged position (FIG. 5C), in which the auxiliary pawl 140 is disengaged from the primary lever 138 to permit the primary lever 138 to move to the second position thereof, the auxiliary pawl 140 being biased to the engaged position. It is also preferred that the vehicle door latch 120 includes an electrical motor 141 that is operably connected to the ratchet gear 132, the primary lever 138, and the auxiliary pawl 140 for release and reset thereof. Also, an auxiliary lever 143 is included in the vehicle door latch assembly 118. The auxiliary lever 143 preferably is movable to a reset position (FIG. 5D), in which the auxiliary lever 143 urges the primary lever 138 to the first position thereof, and to an inactive position (FIGS. 5B, 5C), in which the auxiliary lever 143 permits the primary lever 138 to move to the second position thereof. In one embodiment, it is also preferred that the vehicle door latch assembly 118 includes a key lever 146 for mechanically transmitting rotation from a key cylinder 150 for moving the key lever 146 to a first active position (FIG. 5C), in which the key lever 146 urges the auxiliary pawl 140 to the disengaged position thereof, and to a second active position (FIG. 5D), in which they key lever 146 urges the auxiliary lever 143 to the reset position thereof.

As will be described, it is preferred that rotation of a key 122 in the key cylinder in a first preselected direction (indicated by arrow "2$A_1$" in FIG. 5F) moves the key lever 146 to the first active position, and rotation of the key 122 in a second preselected direction (indicated by arrow "2$A_2$") moves the key lever 146 to the second active position. In one embodiment, the second preselected direction preferably is opposite to the first preselected direction.

When the key 122, received in the key cylinder 150, is moved in the first preselected direction by a first preselected radial distance, the vehicle door latch assembly 120, if in the open condition thereof, is reset to the closed condition, as will be described. Also, when the key 122 in the key cylinder 150 is moved in the second preselected direction by a second preselected radial distance, the vehicle door latch assembly 120, if in the closed condition thereof, is moved to the open condition. It will be understood that, when the vehicle door latch assembly 120 is in the open condition and the door in which it is mounted is moved in the direction indicated by arrow "2D" in FIG. 5A, the striker 124 is received in the fishmouth slot 130 and in the ratchet gear slot 134. As will be described, if the ratchet gear 132 is directed against the striker 124 with sufficient force when the striker 124 is in the slot 134, the striker 124 causes the ratchet gear 132 to move from the open position to the closed position thereof.

Figure 5B:
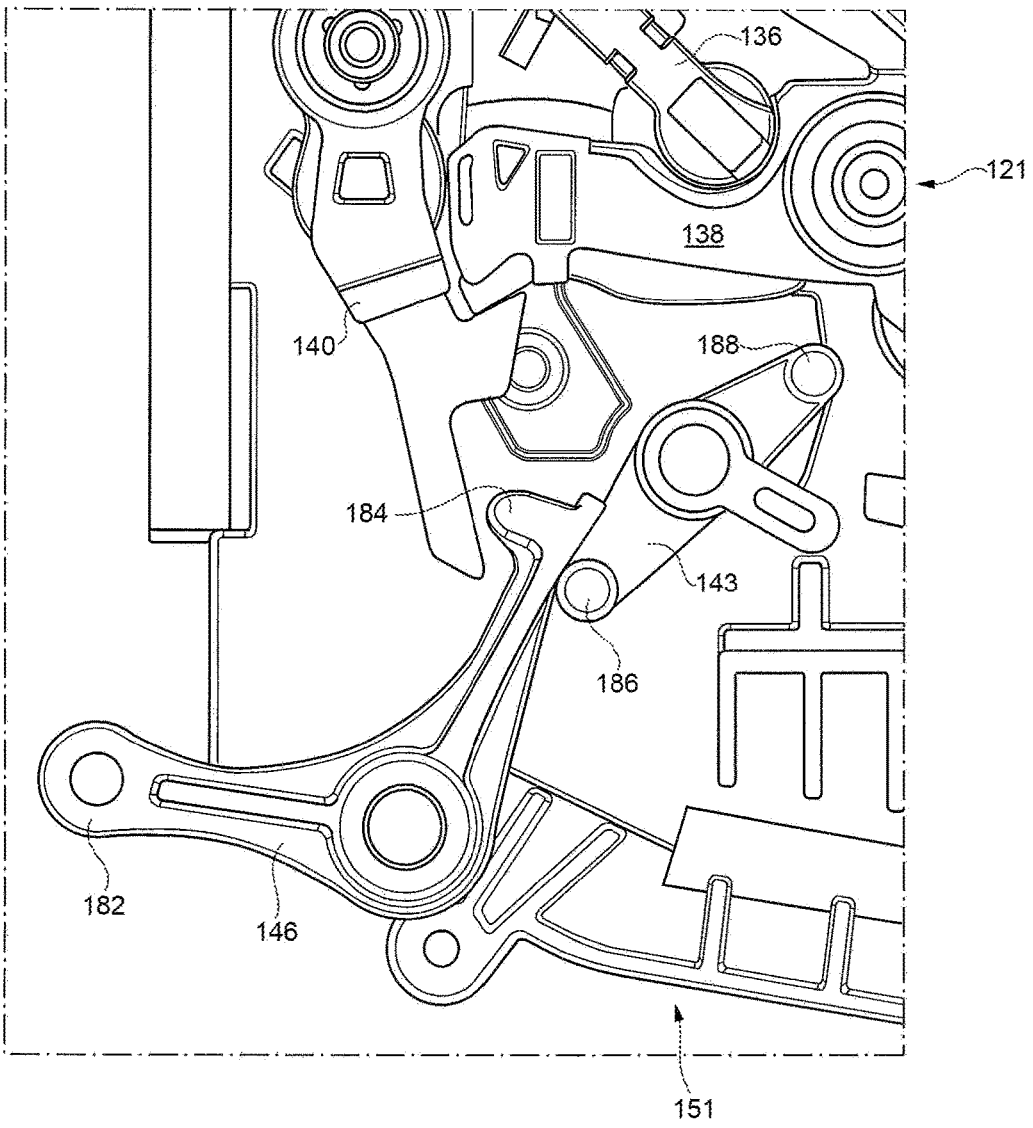
FIG. 5B is a front view of a portion of the vehicle door latch of FIG. 5A in which the vehicle door latch is in a closed condition, drawn at a larger scale.
Figure 5C:
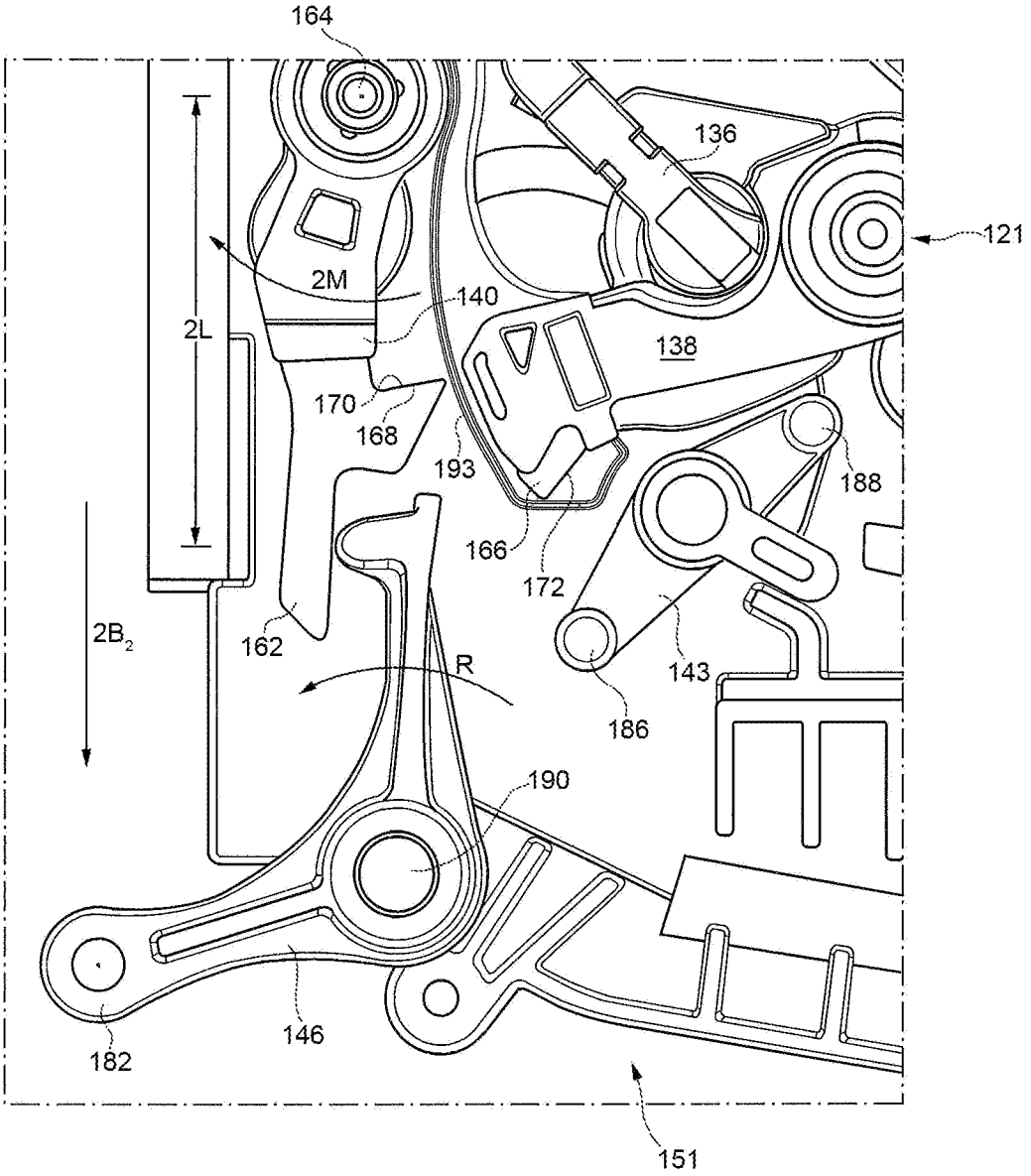
FIG. 5C is a front view of the portion of the vehicle door latch of FIG. 5A in which the vehicle door latch is in an open condition.
Figure 5D:
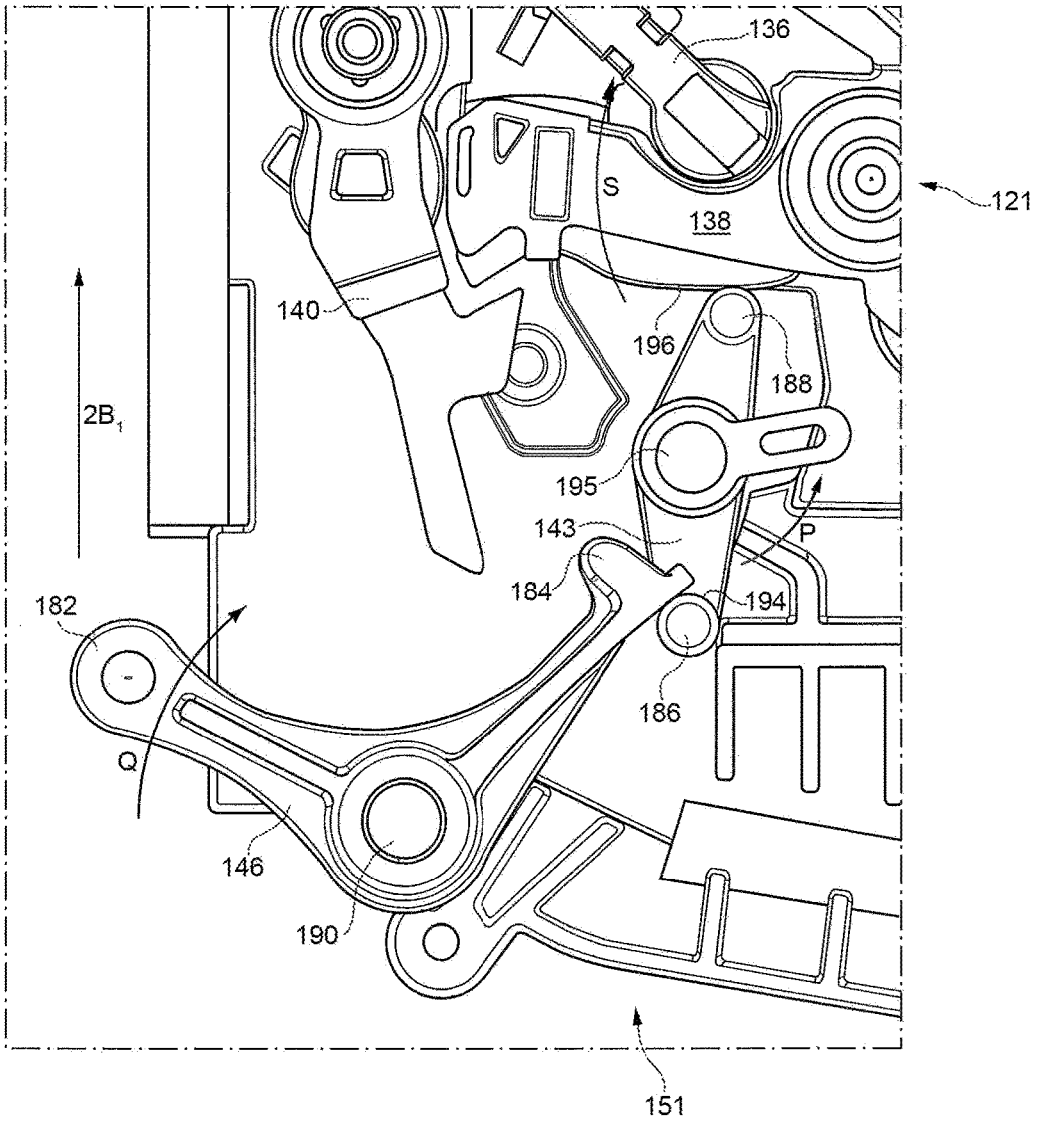
FIG. 5D is a front view of the portion of the vehicle door latch of FIG. 5A, in which the vehicle door latch is in a reset condition.

As can be seen in FIGS. 5C and 5D, the key lever 146 preferably extends between an input end 182 mechanically connected to the key cylinder 150 for transmission of rotation of the key 122 when received in the key cylinder 150 to the output end 182 and an output end 184. The output end 184 preferably is engaged with the auxiliary pawl 140 when the key lever 146 is in the first active position and engaged with the auxiliary lever 143 when the key lever 146 is in the second active position. It is also preferred that the key lever 146 is positionable in an intermediate position (shown in FIG. 5B) between the first and second active positions, in which the key lever is inactive.

In one embodiment, the auxiliary lever 143 preferably extends between first and second ends 186, 188 thereof (FIGS. 5B-5D). Upon the output end 184 of the key lever 146 engaging the first end 186 of the auxiliary lever 143 and urging the first end 186 to move in a first predetermined direction thereof (indicated by arrow "P" in FIG. 5D), the second end 188 of the auxiliary lever 143 also moves in the first predetermined direction to urge the primary lever 138 to the first position thereof.

Figure 5E:
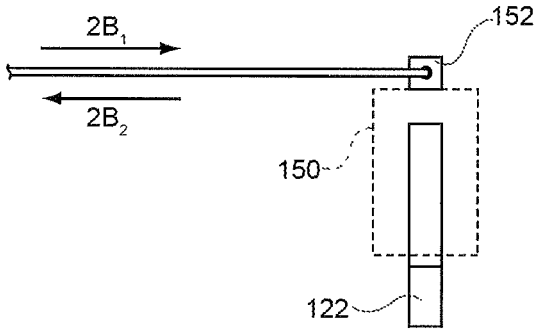
FIG. 5E is a top view of a key cylinder and a key, drawn at a larger scale.
Figure 5F:
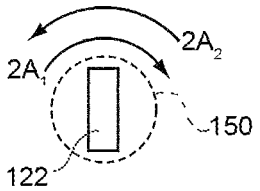
FIG. 5F is a front view of the key cylinder and the key of FIG. 5E.
Figure 5G:
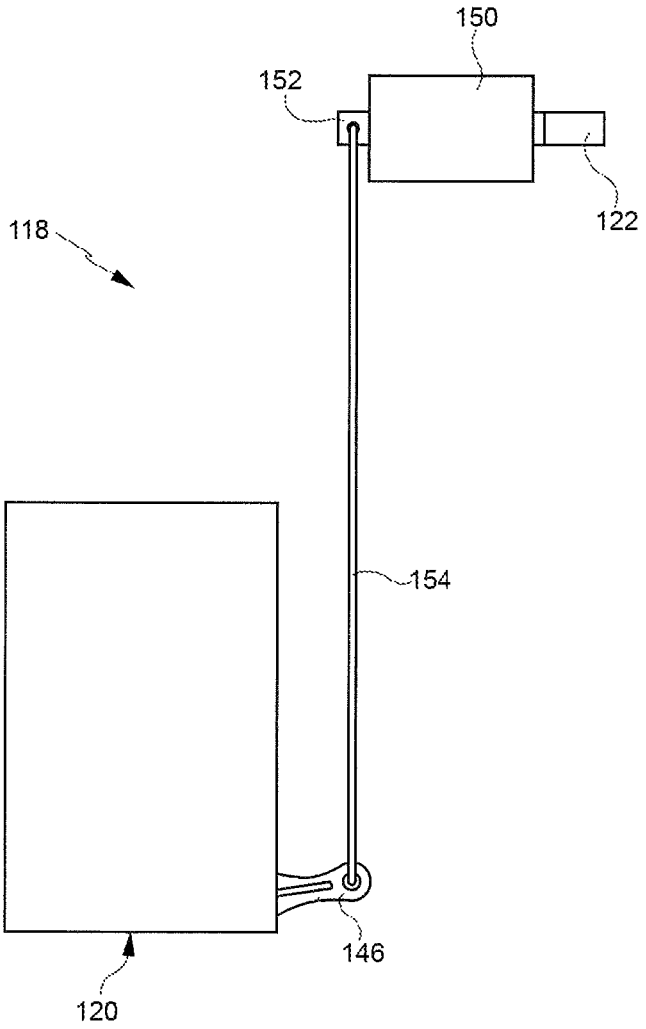
FIG. 5G is a schematic drawing in which the elements of an embodiment of the vehicle door latch assembly of the invention are represented.

It will be understood that the vehicle door latch assembly 118 (FIG. 5G) preferably is mounted in a vehicle door, similarly to the vehicle door latch assembly 18 described above. As can be seen in FIGS. 5E and 5F, the key cylinder 150 preferably has a linkage element 152 linked to a connecting element 154 that connects the linkage element 152 and the key lever 146, at the input end 182 thereof. It will also be understood that the connecting element 154 is not shown in FIGS. 5A-5C for clarity of illustration.

When the key 122 is received in the key cylinder 150, rotation of the key 122 in the first preselected direction results in the connecting element 154 moving in the direction indicated by arrow "2$B_1$" in FIGS. 5D and 5E. When this happens, the key lever 146 is pivoted about its axis 190 in the direction indicated by arrow "Q" in FIG. 5D. As noted above, when the key 122 in the key cylinder 150 is rotated in the first preselected direction by the first preselected radial distance, the vehicle door latch assembly 120 is moved to the reset condition.

In addition, and also as noted above, when the key 122 in the key cylinder 150 is moved in the second preselected direction by the second preselected radial distance, the vehicle door latch assembly 120 is moved from the closed condition to the open position. This movement will now be described in detail. As can be seen in FIGS. 5E and 5F, when the key 122 is turned in the second preselected direction (indicated by arrow "2$A_2$" in FIG. 5F), the connecting element 154 is moved in the direction indicated by arrow "2$B_2$" in FIGS. 5C and 5E. As shown in FIG. 5C, when this occurs, the key lever 146 pivots in the direction indicated by arrow "R". When the key 122 is rotated in the second preselected direction by the second preselected radial distance, the output end 184 urges the auxiliary pawl 140 in the direction indicated by arrow "2M" in FIG. 5C.

It will be understood that certain elements of the vehicle door latch assembly 120 are biased, as described above. Preferably, the ratchet gear 132 is biased for movement thereof from the closed position to the open position, as indicated by arrow "2E" in FIG. 5A. It is also preferred that the primary lever 138 is biased for movement in the direction indicated by arrow "2G" in FIG. 5A. Also, the auxiliary pawl 140 preferably is biased to move in the direction indicated by arrow "2H" in FIG. 5A.

It will be understood that the means for biasing those elements of the vehicle door latch 120 that are biased are omitted from FIGS. 5A-5G for clarity of illustration. Such means for biasing are generally as illustrated in FIG. 2B, although there are some differences that are not material. Because the biasing means are well known in the art, further description thereof is unnecessary.

As will be described, the vehicle door latch 120 preferably includes a ratchet and pawl combination 121. The electrical motor 141 and mechanical means that mechanically connect the electrical motor 141 and the ratchet and pawl combination 121 are outlined in dashed lines in FIG. 5A. However, for clarity of illustration, the motor 141 and the means connection the motor 141 to the ratchet and pawl combination are otherwise omitted from FIGS. 5A-5G for clarity of illustration. Because the operation of the electrical motor has been described in patent application number PCT/EP2012/002238 referred to above, further description thereof is unnecessary.

Accordingly, and as can be seen in FIGS. 5A and FB, when the vehicle door latch assembly 120 is in a closed condition, the auxiliary pawl 140 is in its engaged position, to which it is biased. To move the vehicle door latch assembly 120 to the open condition, the key 122 is rotated in the second preselected direction (indicated by arrow "2$A_2$" in FIG. 5F) by the second preselected radial distance, causing the key lever 146 to pivot in the direction indicated by arrow "R" (to the first active position of the key lever 146), so that the output end 184 thereof urges the auxiliary pawl 140 to pivot in the direction indicated by arrow "2M", i.e., against the auxiliary pawl's bias, to the disengaged position thereof.

As can be seen in FIG. 5C, when the key lever 146 moves to its first active position, the output end 184 of the key lever 146 preferably engages an end part 162 of the auxiliary pawl 140. The bias load is imposed by a spring (not shown) on the auxiliary pawl 140 substantially at the pivot axis 164 thereof. Because the end part 162 is relatively distant from a pin 164 of the auxiliary pawl 140 about which the auxiliary pawl 140 pivots and because the biasing load is applied substantially at the pin 164, relatively little force is required to be exerted on the end part 162 in order to overcome the bias of the auxiliary pawl 140. The force transmitted through the output end 184 is brought to bear on the auxiliary pawl 140 at the end part 162. Accordingly, the effort to overcome the biasing means is applied at the end part 162, i.e., at a point separated from the pin 164 by the distance "2L" (FIG. 5C). Those skilled in the art would appreciate that applying the load to overcome the bias at the relatively long distance "2L" from the pin 164 provides a mechanical advantage. Accordingly, relatively little force is required to be exerted by the user when rotating the key 122 in the second preselected direction in order to move the vehicle door latch assembly 120 from the closed condition to the open condition thereof.

When the auxiliary pawl 140 pivots to its disengaged position, a stop portion 168 thereof disengages from a toe 166 of the primary lever 138, permitting the primary lever 138 to pivot in the direction indicated by arrow "2G" in FIG. 5A to its second position, because the primary lever 138 is biased for movement in such direction.

When the primary lever 138 moves to its second position (shown in FIG. 5C), the primary pawl 136 is thereby pulled away from engagement with the ratchet gear 132. At that point, the ratchet gear 132 accordingly pivots to the open position thereof, due to its bias.

From the foregoing, it can be seen that the vehicle door latch assembly 120 is moved from the closed condition to the open condition when the key 122 is rotated in the second preselected direction by the second preselected distance. As described above, because of the arrangement of the elements of the vehicle door latch assembly 120, the vehicle door latch assembly 120 is movable to the open condition with the application of relatively little force, to turn the key in the second preselected direction. Among other advantages, this means that the connecting element 154 can be a relatively lightweight element.

Once the vehicle door latch assembly 120 is in the open condition, it can be reset mechanically, i.e., so that it is mechanically moved from the open condition to a reset condition, and subsequently to the closed condition.

In order to reset the vehicle door latch 120 mechanically, the ratchet gear 132 is moved from the open position to the closed position thereof.

Preferably, the ratchet gear 132 is pushed from the open position to the closed position thereof when the striker 124 is engaged therewith, i.e., as the door is moved to close. As can be seen in FIG. 5A, the ratchet gear slot 134 is at least partially defined by first and second slot walls 191, 192 that are formed so that, when the ratchet gear 132 is in the open position thereof and the vehicle door latch 120 is brought into contact with the striker 124 (e.g., when the door is closed), the striker 124 first engages the first slot wall 191, and subsequently engages the second slot wall 192. The first slot wall 197 is oriented so that engagement of the striker 124 therewith causes the ratchet gear 132 to pivot from the open position and toward the closed position. As the door closes, the striker 124 slidingly engages the first slot wall 191, gradually pushing the ratchet gear 132 toward the closed position thereof. As the door continues to close, the striker 124 slidingly engages the second slot wall 192, causing the ratchet gear 132 finally to move to the closed position, and the striker 124 is at that point captured by the ratchet gear 132. The ratchet gear 132 may be held in the closed position by the user holding the door closed (and thus maintaining the ratchet gear in the closed position) until the vehicle door latch 120 is reset.

As noted above, to reset the vehicle door latch assembly 120, the key 122 is rotated in the key cylinder 150, in the first preselected direction indicated by arrow "2$A_1$" in FIG. 5F. The rotation is by the first preselected radial distance.

The corresponding rotation of the linkage element 152 causes the connecting element 154 to move in the direction indicated by arrow "2$B_1$" (FIGS. 5D, 5E). In turn, the connecting element 154 pulls on the input end 182 of the key lever 146, causing the key lever 146 to pivot in the direction indicated by arrow "Q" in FIG. 5D.

It will be understood that the connecting element 154 is omitted from FIG. 5D for clarity of illustration.

Those skilled in the art would appreciate that, as soon as the output end 184 of the key lever 146 ceases to urge the auxiliary pawl 140 to its disengaged position, the auxiliary pawl 140 pivots in the direction indicated by arrow "2H" (FIG. 5A), due to its bias for movement in such direction. However, as can be appreciated based on the positions of the auxiliary pawl 140 and the primary lever 138 as shown in FIG. 5C, when the auxiliary pawl 140 is first released by the key lever 146, the stop portion 168 of the auxiliary pawl 140 engages a substantially smooth lever end wall 193. (It will be understood that the stop portion 168 is not shown in FIG. 5C as engaging the end wall 193 for clarity of illustration.) In order to position an end surface 172 of the toe 166 of the primary lever 138 against a face 170 of the stop portion 168, the primary lever 138 is pivoted in the direction indicated by arrow "S" in FIG. 5D, as will be described. Movement of the primary lever 138 in this direction is contrary to the bias to which the primary lever 138 is subject.

As can be seen in FIG. 5D, the pivoting movement of the key lever 146 (i.e., in the direction indicated by arrow "Q" in FIG. 5D) causes the output end 184 thereof to push against a first rod 194 located at the first end 186 of the auxiliary lever 143. As a result, the auxiliary lever 143 pivots about a pin 195 thereof in the direction indicated by arrow "P" so that the second end 188 of the auxiliary lever 143 engages a side 196 of the primary lever 138.

As illustrated in FIG. 5D, the second end 188 of the auxiliary lever 143 pushes against the side 196 of the primary lever 138 to pivot the primary lever 138 in the direction indicated by arrow "S" sufficiently to position the end surface 172 for engagement with the face 170 of the stop portion 168. At this point, the second end 188 of the auxiliary lever 143 ceases to urge the primary lever 138 in the direction indicated by arrow "S", permitting the end surface 172 of the toe 166 to engage the face surface 170 of the stop portion 168.

As described above, with the vehicle door closed, the ratchet gear 132 remains in the closed position. It will be understood that, while the key cylinder 150 of the vehicle door latch assembly 118 is operated (as hereinafter described) to reset the vehicle door latch 120, the vehicle door is held closed, to maintain the ratchet gear 132 in the closed position, until the vehicle door latch 120 has been reset. The vehicle door is held closed by pressure exerted from the exterior (e.g., exerted by the user (not shown)), directed toward the interior of the vehicle.

It will be appreciated that, when the ratchet gear 132 is in the closed position (as described above), as the primary lever 138 is pushed to its first position by the auxiliary lever 141, a flat surface 178 of an end portion 174 of the primary pawl 136 is moved into position to engage a surface 180 of a step 176 formed in the ratchet gear 132. Because the ratchet gear 132 is biased to the open position, once the pressure on the exterior of the vehicle door is released, the ratchet gear 132 pivots toward the open position thereof, bringing the surface 180 of the step 176 into secure engagement with the flat surface 178 of the end portion 174. Accordingly, the vehicle door latch 120 is mechanically reset to the closed condition.

As can be seen most clearly in FIG. 5A, the vehicle door latch 120 preferably includes the ratchet and pawl combination 121, which includes the ratchet gear 132, the primary pawl 136, the primary lever 138, and the auxiliary pawl 140. As noted above, the electrical motor 141 preferably is operatively connected to the ratchet and pawl combination 121 for release and reset of the ratchet and pawl combination 121. However, the vehicle door latch assembly 118 is for operating the vehicle door latch 120 when the motor is inoperable. The vehicle door latch assembly 118 includes the vehicle door latch 120, and preferably also includes the key receiver (or key cylinder) 150 in which the key 122 is rotatable. It is also preferred that the vehicle door latch assembly 118 includes a key receiver mechanical advantage means 151 mechanically connected to the key receiver 150, as will be described. Preferably, the key receiver 150 is operatively connected mechanically via the key receiver mechanical advantage means 151 to the ratchet and pawl combination 121 for release and reset of the ratchet and pawl combination 121 under movement of at least a part 152 of the key receiver 150 when mechanically engaged by the key 122. In this way, the vehicle door latch assembly 118 provides a mechanical release means for moving the vehicle door latch 120 from the closed condition to the open condition, and also a mechanical reset means for resetting the vehicle door latch 120 from the open condition to the closed condition. The vehicle door latch assembly 118 is operable from the exterior of the vehicle. Accordingly, the mechanical release means may be used if the motor 141 is inoperable, for example, due to a failure of the power supply to the motor 141.

From the foregoing, it can be seen that, from the exterior of the vehicle, the vehicle door latch assembly 118 can be utilized to move the vehicle door latch 120 to the open condition without using the motor 141, e.g., so that the door can be opened, to allow a passenger (not shown) to exit the vehicle. Similarly, the vehicle door latch assembly 118 can be utilized to reset the vehicle door latch 120 so that the vehicle door can be closed, and the striker 124 captured by the ratchet gear 132, without using the motor 141.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

The invention claimed is:

1. A vehicle door latch assembly in a motor vehicle having a vehicle door moveable between open and closed positions relative to a vehicle body having a striker, the vehicle door latch assembly comprising:

a vehicle door latch mounted to the vehicle door and comprising:

a base including a slot in which at least part of the striker mounted to the vehicle body is receivable upon movement of the vehicle door to the closed position;

a ratchet gear including a slot, the ratchet gear being pivotably mounted on the base and positionable to at least partially align the slot in the ratchet gear with the slot in the base, the ratchet gear being pivotable between a closed position in which the striker is captured by the ratchet gear and an open position in which the slot in the ratchet gear is at least partially aligned with the slot in the base to release the striker;

a ratchet gear biasing member for biasing the ratchet gear toward the open position;

a primary pawl movable between a secured position in which the primary pawl is positioned to hold the ratchet gear in the closed position and an unsecured position in which the primary pawl is positioned to permit the ratchet gear to move to the open position;

a primary lever to which the primary pawl is operatively connected, the primary lever being movable between a first position in which the primary lever holds the primary pawl in the secured position and a second position in which the primary lever moves the primary pawl to the unsecured position;

a primary lever biasing member for biasing the primary lever toward the second position;

an auxiliary pawl movable between an engaged position in which the auxiliary pawl holds the primary lever in the first position and a disengaged position in which the auxiliary pawl is disengaged from the primary lever to permit the primary lever to move to the second position;

an auxiliary pawl biasing member for biasing the auxiliary pawl toward the engaged position; and an electrical motor operatively connected to at least one of the ratchet gear, the primary lever and the auxiliary pawl;

an auxiliary lever movable between a reset position in which the auxiliary lever urges the primary lever to move from the second position and to the first position an inactive position in which the auxiliary lever permits the primary lever to move from the first position to the second position; and a key lever moveable between a first active position in which the key lever urges the auxiliary pawl to the disengaged position and a second active position in which the key lever urges the auxiliary lever to the reset position.

2. The vehicle door latch assembly according to claim 1 further including a rotatable key cylinder, wherein rotation of the key cylinder in a first preselected direction moves the key lever to the first active position, and wherein rotation of the key cylinder in a second preselected direction moves the key lever to the second active position.

3. The vehicle door latch assembly according to claim 2 wherein an input end of the key lever is mechanically connected to the key cylinder, wherein an output end of the key lever is configured for engagement with the auxiliary pawl when the key lever is moved to the first active position and is configured for engagement with the auxiliary lever when the key lever is moved to the second active position, and wherein the key lever is positionable in an intermediate position between the first and second active positions when the auxiliary lever is in the inactive position.

4. The vehicle door latch assembly according to claim 3 wherein movement of the key lever to the second active position causes the output end to engage a first end of the auxiliary lever and forcibly move the auxiliary lever to the reset position such that a second end of the auxiliary lever engages the primary lever and forcibly moves the primary lever to the first position.

5. The vehicle door latch assembly according to claim 1 wherein the vehicle door latch is in a closed condition when the ratchet gear is located in the closed position and is in an open condition when the ratchet gear is located in the open position, wherein movement of the key lever to the first active position causes the vehicle door latch to move from the closed condition into the open condition since movement of the auxiliary pawl to the disengaged position causes the primary lever to move to the second position for moving the primary pawl to the unsecured position so as to permit the ratchet gear to move to the open position, and wherein movement of the key lever to the second active position causes the vehicle door latch to reset in the closed condition since movement of the auxiliary lever to the reset position causes the primary lever to move from the second position into the first position so as to permit the auxiliary pawl to be biased back into the engaged position and locate the primary pawl in the secured position for holding the ratchet gear in the closed position.

6. The vehicle door latch assembly according to claim 5 wherein the key lever is mechanically connected to a rotatable key receiver via a connector element, wherein rotation of the key receiver in a first direction results in movement of the key lever to the first active position and rotation of the key receiver in a second direction results in movement of the key lever to the second active position, and wherein the key receiver is manually moved between the first and second active positions via rotation of a door key inserted into the key receiver by a user.

7. A vehicle door latch assembly in a motor vehicle having a vehicle door moveable between open and closed positions relative to a vehicle body having a striker, the vehicle door latch assembly comprising:

a vehicle door latch mounted to the vehicle door and comprising a ratchet and pawl combination, wherein the ratchet and pawl combination comprises:

a ratchet gear movable between a closed position in which the striker mounted to the vehicle body is at least partially captured by the ratchet gear and an open position in which the striker is released by the ratchet gear, the ratchet gear being biased to the open position by a ratchet gear biasing member;

a primary pawl movable between a secured position in which the primary pawl is positioned to hold the ratchet gear in the closed position and an unsecured position in which the primary pawl is positioned to permit the ratchet gear to move to the open position;

a primary lever to which the primary pawl is operatively connected, the primary lever being movable between a first position in which the primary lever holds the primary pawl in the secured position and a second position in which the primary lever moves the primary pawl to the unsecured position, the primary lever being biased to the second position by a primary lever biasing member; and an auxiliary pawl movable between an engaged position in which the auxiliary pawl holds the primary lever in the first position and a disengaged position in which the auxiliary pawl is disengaged from the primary lever to permit the primary lever to move to the second position, the auxiliary pawl being biased to the engaged position by an auxiliary pawl biasing member;

an electrical motor operatively connected to the ratchet and pawl combination for powered operation of the ratchet and pawl combination;

a key receiver in which a key is rotatable;

a key receiver connection mechanism for mechanically connecting the key receiver to the ratchet and pawl combination for manual operation of the ratchet and pawl combination under movement of the key receiver when mechanically engaged by the key;

an auxiliary lever moveable between a reset position in which the auxiliary lever urges the primary lever to move from the second position into the first position and an inactive position in which the auxiliary lever permits the primary lever to move from the first position into the second position; and a key lever mechanically connected to the key receiver such that rotation of the key receiver in a first direction causes the key lever to move to a first active position and rotation of the key receiver in a second direction causes the key lever to move to a second active position, wherein the key lever is operable in the first active position to cause the auxiliary pawl to move to the disengaged position, and wherein the key lever is operable in the second position to cause the auxiliary lever to move to the reset position.

8. The vehicle door latch assembly according to claim 7 wherein the vehicle door latch is in a closed condition when the ratchet gear is located in the closed position and is in an open condition when the ratchet gear is located in the open position, wherein movement of the key lever to the first active position causes the vehicle door latch to move from the closed condition into the open condition since movement of the auxiliary pawl to the disengaged position causes the primary lever to move to the second position for moving the primary pawl to the unsecured position so as to permit the ratchet gear to move to the open position, and wherein movement of the key lever to the second active position causes the vehicle door latch to reset in the closed condition since movement of the auxiliary lever to the reset position causes the primary lever to move from the second position into the first position so as to permit the auxiliary pawl to be biased back into the engaged position and locate the primary pawl in the secured position for holding the ratchet gear in the closed position.

9. The vehicle door latch assembly according to claim 8 wherein the key lever is mechanically connected to a rotatable key receiver via a connector element, wherein rotation of the key receiver in a first direction results in movement of the key lever to the first active position and rotation of the key receiver in a second direction results in movement of the key lever to the second active position, and wherein the key receiver is manually moved between the first and second active positions via rotation of a door key inserted into the key receiver by a user.

10. A vehicle door latch assembly comprising:

a ratchet gear movable between a closed position and an open position, the ratchet gear being biased to the open position by a ratchet gear biasing member;

a primary pawl movable between a secured position in which the primary pawl is positioned to hold the ratchet gear in the closed position and an unsecured position in which the primary pawl is positioned to permit the ratchet gear to move to the open position;

a primary lever to which the primary pawl is operatively connected, the primary lever being movable between a first position in which the primary lever holds the primary pawl in the secured position and a second position in which the primary lever moves the primary pawl to the unsecured position, the primary lever being biased to the second position by a primary lever biasing member;

an auxiliary pawl movable between an engaged position in which the auxiliary pawl holds the primary lever in the first position and a disengaged position in which the auxiliary pawl is disengaged from the primary lever to permit the primary lever to move to the second position, the auxiliary pawl being biased to the engaged position by an auxiliary pawl biasing member;

an electrical motor operatively connected to at least one of the ratchet gear, the primary pawl, the primary lever, and the auxiliary pawl for controlling powered movement thereof;

an auxiliary lever movable to a reset position in which the auxiliary lever urges the primary lever to the first position and to an inactive position in which the auxiliary lever permits the primary lever to move to the second position; and a key lever, moveable between a first active position in which the key lever urges the auxiliary pawl to the disengaged position and to a second active position in which the key lever urges the auxiliary lever to the reset position.

11. The vehicle door latch assembly according to claim 10 further including a rotatable key cylinder in which rotation of the key cylinder in a first preselected direction moves the key lever to the first active position and rotation of the key cylinder in a second preselected direction moves the key lever to the second active position.

12. The vehicle door latch assembly according to claim 11 wherein an input end of the key lever is connected to the key cylinder, wherein an output end of the key lever is engaged with the auxiliary pawl when the key lever is in the first active position and the output end of the key lever is engaged with the auxiliary lever when the key lever is in the second active position, and wherein the key lever is positionable in an intermediate position between the first and second active positions in which the auxiliary lever is in the inactive position.

13. A vehicle door latch assembly according to claim 12 wherein movement of the key lever to the second active position causes the output end to engage a first end of the auxiliary lever and forcibly move the auxiliary lever to the reset position such that a second end of the auxiliary lever engages the primary lever and forcibly moves the primary lever to the first position.

14. The vehicle door latch assembly according to claim 10 wherein the vehicle door latch is in a closed condition when the ratchet gear is located in the closed position and is in an open condition when the ratchet gear is located in the open position, wherein movement of the key lever to the first active position causes the vehicle door latch to move from the closed condition into the open condition since movement of the auxiliary pawl to the disengaged position causes the primary lever to move to the second position for moving the primary pawl to the unsecured position so as to permit the ratchet gear to move to the open position, and wherein movement of the key lever to the second active position causes the vehicle door latch to reset in the closed condition since movement of the auxiliary lever to the reset position causes the primary lever to move from the second position into the first position so as to permit the auxiliary pawl to be biased back into the engaged position and locate the primary pawl in the secured position for holding the ratchet gear in the closed position.

* * * * *